US005832755A

United States Patent [19]

Crilly

[11] Patent Number: 5,832,755

[45] Date of Patent: Nov. 10, 1998

[54] SECURITY DEVICE FOR A LADDER

[76] Inventor: Kevin Crilly, 12 Cumberland Drive, Chessington, Surrey KT9 1HQ, United Kingdom

[21] Appl. No.: 887,133

[22] Filed: Jul. 2, 1997

[30] Foreign Application Priority Data

| | | | |
|---|---|---|---|
| Jul. 3, 1996 | [GB] | United Kingdom | 9613950.6 |
| May 30, 1997 | [GB] | United Kingdom | 9711216.3 |

[51] Int. Cl.[6] ..... E05B 69/00

[52] U.S. Cl. ..... 70/58; 70/19; 182/230; 224/323

[58] Field of Search ..... 70/14, 18, 19, 70/57, 58, 233; 224/42.38, 42.39, 42.4, 323; 182/104, 106, 203, 204, 209, 230, 129

[56] References Cited

U.S. PATENT DOCUMENTS

| | | | |
|---|---|---|---|
| 1,499,010 | 6/1924 | Frisk | 224/42.39 |
| 1,532,461 | 4/1925 | Willwerscheid | 224/42.39 |
| 2,880,829 | 4/1959 | Watkins | 182/47 X |
| 3,225,863 | 12/1965 | Ludlow | 182/230 X |
| 3,273,768 | 9/1966 | Duer | 224/323 X |
| 3,372,772 | 3/1968 | Singer | 182/230 |
| 3,672,612 | 6/1972 | Laing, Jr. | 224/323 X |
| 3,888,398 | 6/1975 | Payne | 224/323 X |
| 3,894,414 | 7/1975 | Peterson | 70/19 |
| 3,968,857 | 7/1976 | Bryan | 182/230 X |
| 4,181,195 | 1/1980 | Clark | 182/230 |
| 4,579,197 | 4/1986 | Spurling | 182/230 X |
| 4,827,742 | 5/1989 | McDonald | 70/19 |
| 5,137,194 | 8/1992 | Kodis | 224/323 X |
| 5,441,126 | 8/1995 | Orrick | 182/230 X |
| 5,520,291 | 5/1996 | Graham | 70/58 X |
| 5,526,661 | 6/1996 | Lin | 70/233 |
| 5,609,222 | 3/1997 | Horbacewicz et al. | 182/203 |
| 5,622,064 | 4/1997 | Gluskoter et al. | 70/58 X |

FOREIGN PATENT DOCUMENTS

| | | | |
|---|---|---|---|
| 1290264 | 3/1962 | France | 224/323 |
| 2643409 | 8/1990 | France | 70/58 |
| 142257 | of 0000 | Germany | 70/58 |
| 2063344 | 6/1981 | United Kingdom | 70/58 |
| 2125094 | 2/1984 | United Kingdom | 70/19 |
| 2213521 | 8/1989 | United Kingdom | 70/58 |

*Primary Examiner*—Suzanne Dino Barrett
*Attorney, Agent, or Firm*—Finnegan, Henderson, Farabow, Garrett & Dunner, L.L.P.

[57] ABSTRACT

This disclosure relates to a security device for a ladder, in particular for preventing unauthorised use of a ladder on scaffolding. Accordingly there is provided a security device for securing a longitudinal member such as a scaffolding board to a ladder to prevent use thereof, which device comprises strap means for holding the longitudinal member and ladder engaging means for said strap means, wherein said engaging means comprises tightening means for clamping said strap means against said ladder whereby said longitudinal member may be held against removal from the ladder and locking means adapted to permit locking of the tightening means.

13 Claims, 4 Drawing Sheets

SECURITY DEVICE FOR A LADDER

BACKGROUND OF THE INVENTION

1. Field of the Invention

This invention relates to a security device for a ladder, in particular a ladder for use on scaffolding.

2. Description of the Prior Art

Scaffolding is erected adjacent buildings to provide easy access for builders to different levels of the exterior of the building for construction or repair work. Scaffolding usually comprise vertically spaced horizontal work platforms arranged in an assembled framework of vertical and horizontal tubular bars. The platforms comprise scaffold boards which are arranged side by side to create walkways. Access to upper platforms is provided by ladders which are attached to the framework.

A disadvantage of scaffolding is that in addition to providing easy access for builders, it provides trespassers, burglars and vandals with equally easy access to the building upon which it is used. This is a particular problem when the scaffolding and the building are left unattended, such as at night time or on weekends/holidays. Hence, the security of the building is compromised by the presence of the scaffolding.

In order to overcome this problem of unwanted access one solution is to render the ladders inaccessible. Typically this may be done by rope-tying a scaffolding board to the ladder so that it extends over and is held against the rungs of the ladder. This ensures that there is insufficient space between the board and the rungs to enable the rungs to be mounted. Hence, the ladder cannot be climbed. However, a determined burglar will only be delayed rather than dissuaded by this tactic as the rope can be readily cut and the scaffolding board removed. Furthermore, the continual tying of the securing rope whenever the scaffolding is to be left unattended, and the subsequent untying thereof when authorised access to the scaffolding is required, is time consuming, particularly when there are a number of ladders on the scaffolding.

OBJECT OF THE INVENTION

There is a need for a means of securing a ladder, particularly a ladder for use on scaffolding, against unauthorised access but which is quick to apply and release and is not easily overcome by someone attempting unauthorised access.

SUMMARY OF THE INVENTION

To achieve the objects and in accordance with the purpose of the invention, as embodied and broadly described herein, the security device of this invention comprises strap means adapted to lay transversely across the scaffolding board when the scaffolding board is longitudinally aligned with the ladder and is juxtaposed the rungs of the ladder, ladder engaging means for attaching the strap means to the ladder, tightening means for the ladder engaging means, which tightening means is operable to cause the strap means to clamp said scaffolding board against the ladder whereby the scaffolding board may be held against removal from the ladder, and locking means adapted to permit locking of the tightening means in a clamped position in which the scaffolding board is clamped against the ladder.

The strap means may comprise a rigid elongate member. Preferably the strap means comprises an elongate metal bar.

The ladder engaging means may comprise one or more hooks for engaging said ladder. The engaging means may be adapted to engage one or both ladder uprights and/or one or more ladder rungs.

In a preferred arrangement the ladder engaging means comprises first and second hook members. Preferably one hook member is disposed at one end of the strap means and the other hook member at the other end of the strap means.

The reach of one or both of said hook members may be adjustable, by for example adaptation to threadably engage said strap means.

The tightening means may comprise a tightening member which acts to cause said ladder engagement means to approach and grasp the ladder. The tightening member may be threaded for engagement with the ladder engagement means whereby rotation of said tightening member causes the engagement means to approach and grasp the ladder. The tightening member may comprise a nut for engagement with a thread on said tightening member. However in a preferred arrangement said tightening member comprises a handle with a threaded axis of rotation, preferably at one end of said handle.

The tightening means may comprise a camming handle movable to cause the ladder engagement means to approach and grasp the ladder.

The locking means may comprise means to lock or permit locking of the tightening means against movement. Such means may comprise a lock and in particular a padlock. Alternatively the locking means may comprise lock engagement means to which a lock may be attached. In a preferred arrangement the lock engagement means comprises a hole in one end of a tightening member handle which in a clamping position may be aligned with a hole in the strap means, thereby to permit a padlock to be threaded through both holes.

In a particular embodiment of the invention there is provided a security device comprising an elongate rigid bar carrying at one end thereof a first hook member comprising a stem portion and a hook portion, which stem portion threadably engages said rigid bar and which hook portion is adapted to engage said ladder, which rigid bar carries at another end thereof a second hook member a stem portion of which slideably engages said rigid bar and a hook portion of which is adapted to engage said ladder, wherein the stem of the second hook member threadably engages a tightening handle carried by said stem of the second hook member, and wherein an extension of said rigid bar is provided with a hole with which may be aligned a hole in said tightening handle for locking of said handle against said rotation, the arrangement being such that the reach of the first hook may be adjusted by rotation thereof in said rigid bar when not engaged with said ladder and the reach of said second hook may be reduced when engaged with said ladder by rotation of said handle, and said handle may be locked against rotation by use of a padlock or another suitable lock.

The longitudinal member is preferably a scaffolding board and said security device is dimensioned accordingly.

One of the advantages provided by the security device of the present invention is that a scaffolding board can be securely, and relatively quickly, clamped against the rungs of a ladder to prevent the ladder being climbed.

Following is a description of methods of putting the present invention into effect by way of example only and with reference to the figures of the drawings.

DETAILED DESCRIPTION

First Embodiment

Figure 1:
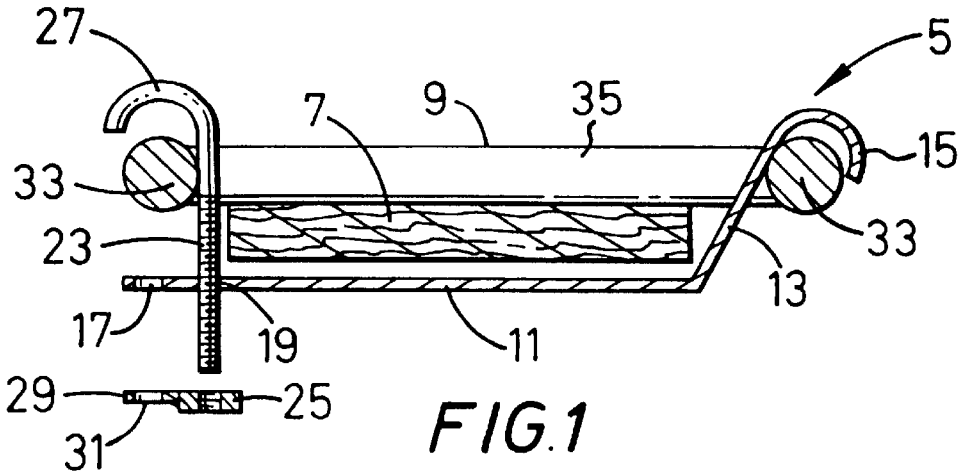
FIG. 1 is a section of a first embodiment of a security device for a ladder in position on a ladder.
Figure 2:
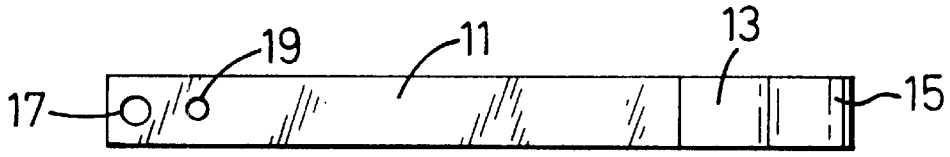
FIG. 2 is a side elevation of a portion of the security device of FIG. 1.

FIG. 1 shows a security device 5 for clamping a scaffolding board 7 adjacent a scaffolding ladder 9. This device 5 has a bar 11 from one end of which and at an oblique angle thereto extends an arm 13 which has at its extremity a hook portion 15. At the end of the bar 11 which is remote from the arm 13, two longitudinally spaced holes 17 and 19 (see FIG. 2) are provided, the outer one of which 17 has a diameter which is larger than that of the inner hole 19.

Hole 19 is adapted to accommodate a threaded stem portion 21 of a removable hooked member 23, which in use extends through the inner hole 19 and carries a nut 25 on the side of the bar 11 remote from its hooked extremity 27.

The nut 25 is secured to an arm 29 for rotation therewith, which arm 29 has a hole 31 defined therethrough of substantially the same diameter as that of the outer hole 17. The hole 31 is positioned on the arm 29 so that it can be brought into alignment with the hole 17, and the shackle of a padlock can be located through each of the holes 17 and 31 to lock the nut 25 relative to the bar 11.

The hooks 15 and 27 at the end of the arm 13 and the hooked member 23 respectively are shaped so that they can each fit round the upright side members 33 or the rungs 35, as the case may be; of the scaffolding ladder 9 on which the security device 5 is to be used. The length of the bar 11 between the inner hole 19 and the position from which the arm 13 extends should be comparable to the width of the scaffolding board 7 which is to be used.

Typical dimensions of a scaffolding board 7 are 9 inches by 1.5 inches by up to 13 feet in length.

When the security device 5 is to be used to clamp a scaffolding board 7 adjacent a scaffolding ladder 9, the scaffolding board 7 is placed against the rungs 35 of the ladder 9. The hook 15 is hooked around one of the upright side supports 33 of the ladder 9, so that the arm 13 extends through the ladder 9. The bar 11 is then rotated about the upright side support 33 around which the hook 15 is hooked, to a position in which it overlies the scaffolding board 7. The hooked member 23 is then passed from the side of the ladder 9 remote from the bar 11, between the edge of the board 7 and the other of the upright side supports 33 and through the inner hole 19 in the bar 11, until it engages the other upright side support 33. The nut 25 is then screwed onto the threaded stem portion 21 and tightened against the bar 11. Since the bar 11 and the arm 13 can pivot about the upright side support 33, and the hooked member 23 is prevented from moving by the engagement of its hook 27 with the other upright side member 33 of the ladder 9, this tightening action causes the end of the bar 11 adjacent the nut 25 to move towards the hook 27, until the end of the bar 11 engages the board 7 and the board 7 is clamped securely against the rungs 35 of the ladder 9. The shackle of the padlock is then passed through the outer hole 17 in the bar 11 and the hole 31 through the arm 29 on the nut 25 and the padlock is locked so that the nut 25 cannot be rotated to loosen the clamping action of the bar 11. Thus, the board 7 is securely clamped juxtaposed the rungs 35 of the ladder 9 in such a way that the rungs 35 of the ladder 9 cannot be climbed.

In order to release the security device 5, the padlock is unlocked, the nut 25 is rotated to release the hooked member 23 and the bar 11 is disengaged. Hence, the security device 5 can be released quickly and easily by a person who has the key to the padlock.

Second Embodiment

Figure 5:
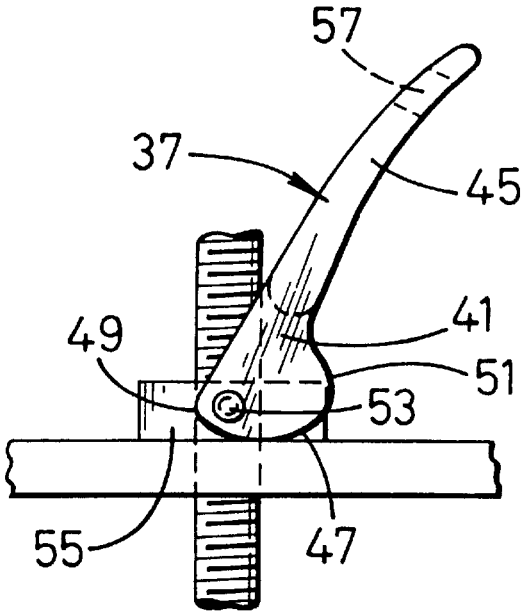
FIG. 5 is a side elevation of the tightening arrangement of FIG. 4.
Figure 6:
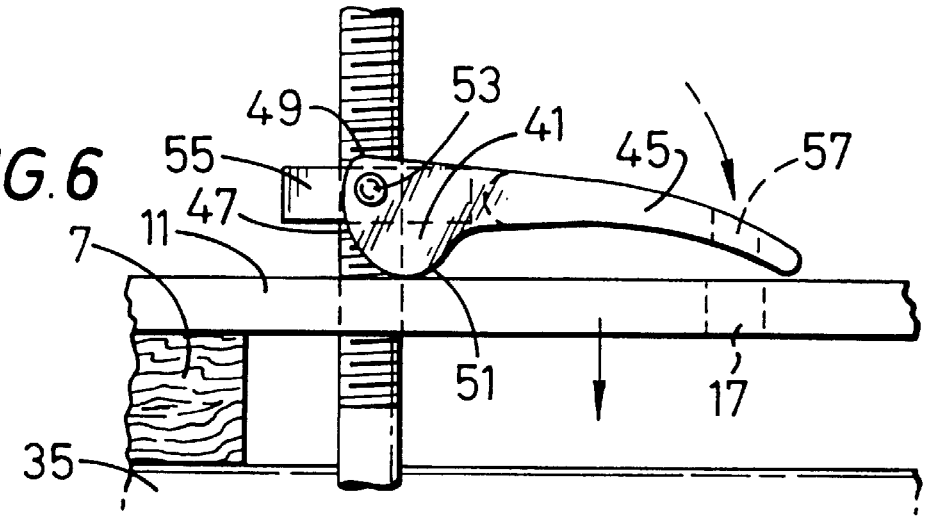
FIG. 6 is an elevation similar to that of FIG. 5, but in which the tightening arrangement is in a clamping position.

The nut 25 may be replaced by a tightening arrangement comprising a camming device 37. An example of such a camming device 37 is shown in FIGS. 4 to 6.

Figure 4:
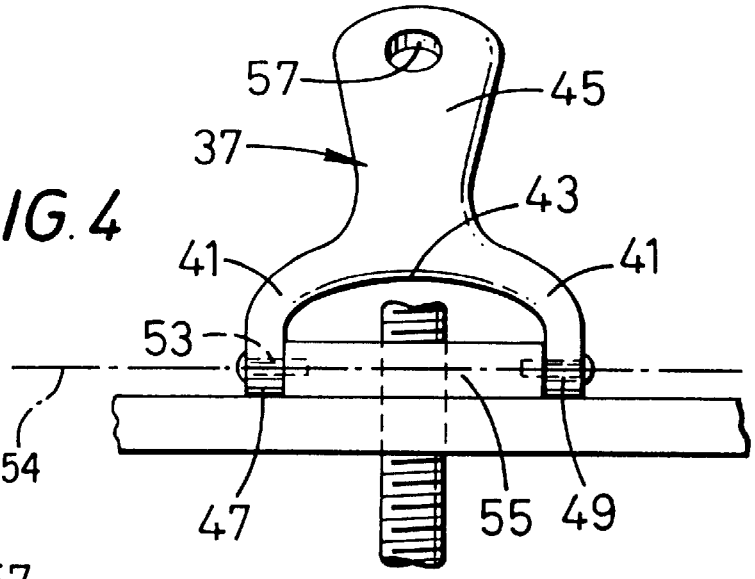
FIG. 4 is a front elevation of a tightening arrangement according to a second embodiment of the present invention.

The camming device 37 has two camming portions 41 which together define an arch 43 from the top of which extends a handle 45 (see FIG. 4). The camming portions 41 each have an arcuate edge 47 which extends from the front 49 to the rear 51 thereof (see FIG. 5), and are mounted for rotation about two lugs 53 which extend one each through their sides and into opposing recesses defined in a nut 55 positioned therebetween. The axis of rotation 54 defined by the lugs 53 is close to the front end 49 of the camming portions 41, so that the distance between the axis of rotation and each arcuate edge 47 increases towards the rear 51 of the camming portions 41. The lugs 53 are secured to the camming portions 41 so that once inserted in the recesses in the nut 55 they cannot be removed therefrom, so that the camming portions 41 and the nut 55 are securely interengaged.

The nut 55 is adapted to be screwed in use onto the threaded stem portion 21 of the hooked member 23, so that the arcuate edges 47 contact the bar 11 on a side thereof remote from the hook 27. The handle 45 has a hole 57 formed therethrough which is positioned so that when in use, it can be brought into alignment with the outer hole 17 through the bar 11. When the holes 17 and 57 are so aligned the shackle of a padlock can be placed through each of the holes 17,57 and locked, so that the camming device 37 is fixed relative to the bar 11.

When the camming device 37 is used instead of the nut 25, its nut 55 is screwed onto the threaded stem portion 21 until the arcuate edges 47 contact the bar 11. A force is then applied to the handle 45 to cause it to rotate towards the bar 11, thereby causing the camming portions 41 to rotate about the axis 54 on their arcuate edges 47 from the front 49 to the rear 51 thereof. Since the distance between the axis 54 and point of contact of the arcuate edge 47 with the bar 11 gradually increases as the camming portion 41 is rotated from the front 47 to the rear 51 thereof, a levering force is applied between the hooked member and the bar 11. Hence, since the bar 11 and the arm 13 can pivot about the upright side support 33, and the hooked member 23 is prevented from moving by the engagement of its hook 27 with the other upright side member 33, this levering action causes the end of the bar 11 adjacent the camming device 37 to move towards the hook 27. As the handle 45 is rotated further towards the bar 11, this levering action is continued, until the end of the bar 11 is moved into engagement with the board 7 and the board 7 is clamped securely against the rungs 35 of the ladder 9, as shown in FIG. 6. At this stage, the shackle of the padlock is then passed through the outer hole 17 in the bar 11 and the hole 57 through the handle 45 and the padlock is locked so that the camming portions 41 cannot be rotated to release the clamping action of the bar 11.

In order to release the security device 5, the padlock is unlocked and the camming device 41 is rotated on its arcuate edges 47 from the rear 51 to the front 49 thereof, thereby releasing the clamping action of the bar 11, so that the nut 55 can be rotated and the camming device 37 removed, so that the hooked member 23 and the bar 11 can be released. Hence, the security device 5 can be released quickly and easily by a person who has the key to the padlock.

Third Embodiment.

Figure 7:
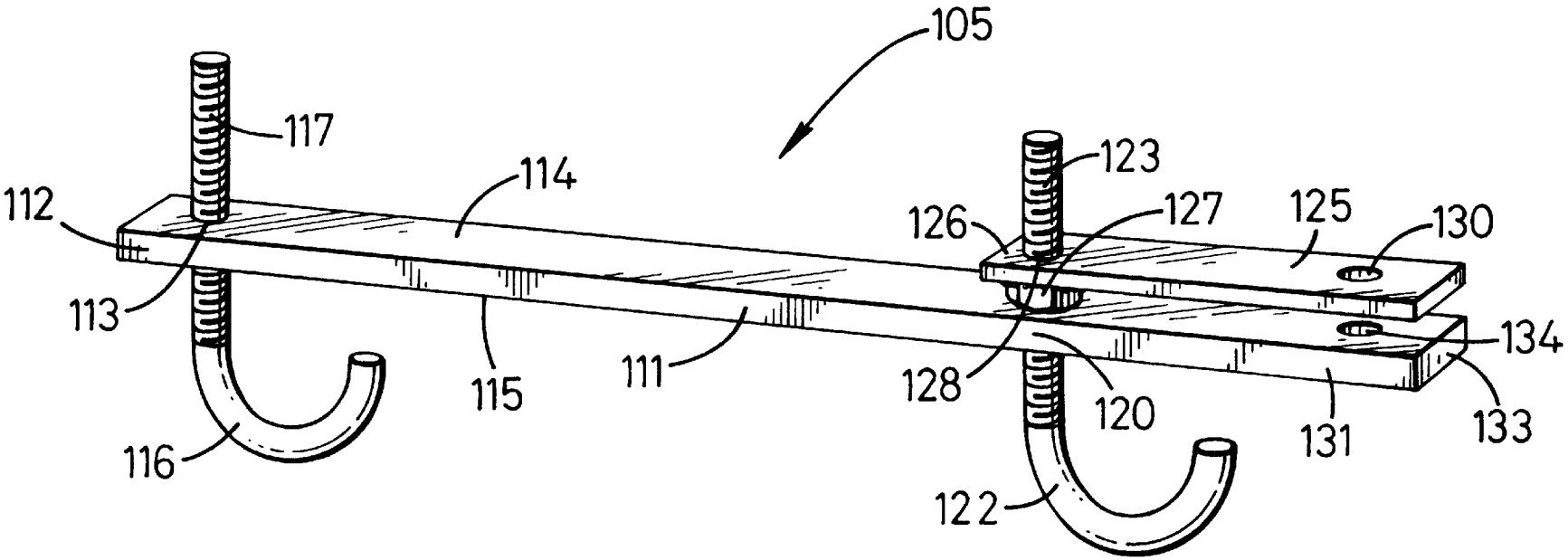
FIG. 7 is a perspective view of a device according to a third embodiment of the present invention.

FIG. 7 shows a security device 105 according to the present invention. This device comprises an elongate rectilinear metal bar 111. A first end 112 of the bar is provided with a threaded hole 113 which extends between an upper surface 114 of the bar and a lower surface 115 (obscured). A first hook 116 is carried in said hole 113. A stem portion 117 of the hook is provided with a threaded surface which is capable of engaging with the thread of the hole 113.

A second end 120 of the bar 111 is provided with a second hole (obscured) which extends between the bar upper and lower surfaces 114,115. The second hole is dimensioned to permit sliding therethrough of a stem portion 123 of the second hook. A handle 125 is provided juxtaposed the upper surface 114 of the bar. One end 126 of the handle carries a nut 127 which is welded to the handle and is coaxial with a hole 128 in said one end 126 of the handle. The nut is disposed in between the top surface 114 of the bar and the handle, thereby shielding the nut from access. The nut carries internally thereof a thread which engages the stem portion 123 of the second hook. The other end of the handle is provided with a hole 130.

The bar 111 is provided with an extension 131 to the second end 120 of the bar, as shown in FIG. 1. A remote end 133 is provided with a hole 134 extending between upper and lower surfaces 114,115 of the bar. When the handle is disposed over the extension 131, the holes 134 and 130 are aligned so that a locking member may be accommodated by both holes.

Figure 8:
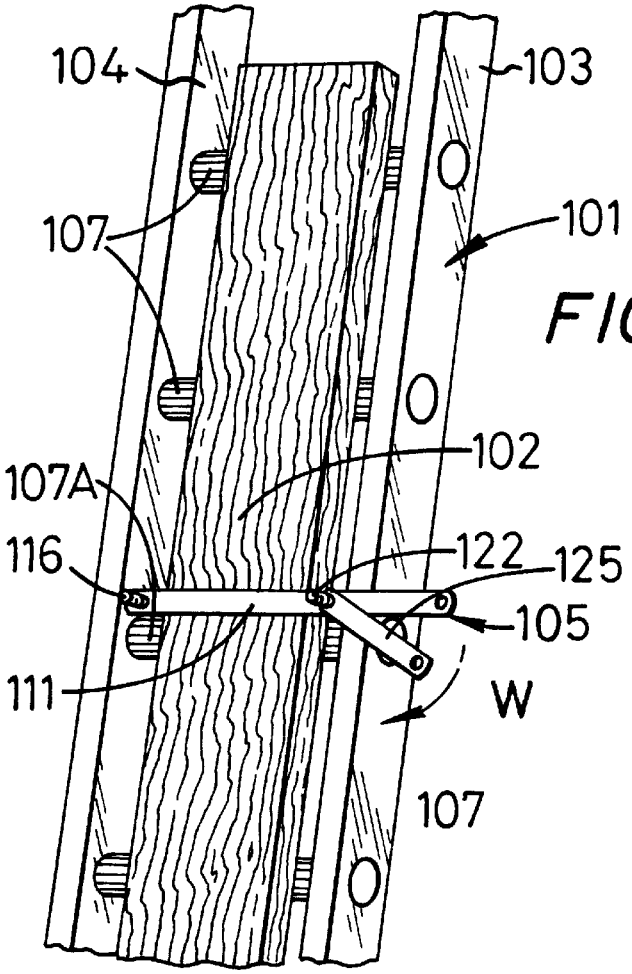
FIG. 8 is a perspective view of the device of FIG. 7 in position on a ladder.
Figure 9:
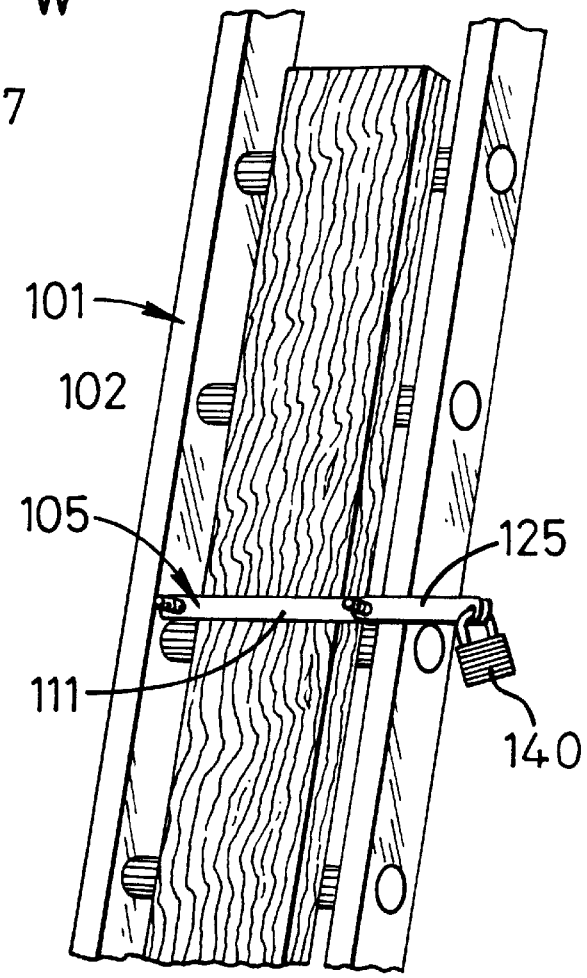
FIG. 9 is a perspective view of the device of FIG. 7 in position on a ladder.

A security device as described in the forgoing is shown in use in FIG. 8. A ladder 101 is shown upstanding and with a scaffold board 102 disposed between uprights 103 and 104 of the ladder, resting against rungs 107 of the ladder. The security device 105 is shown with the bar overlaid the scaffold board and with the hooks 116,122 engaging a rung 107A. The handle 125 is wound in the direction W shown in the figure to tighten the second hook 122 against the rung and in order to draw the bar 111 against the scaffold board 102, thereby holding it (102) firmly in position.

Figure 3:
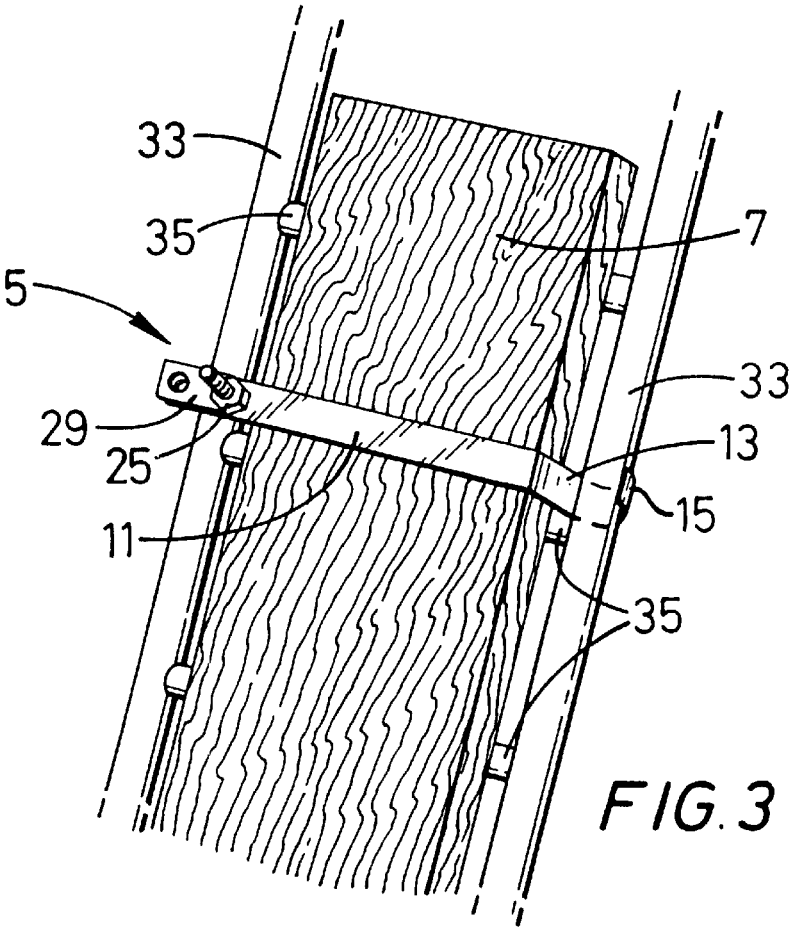
FIG. 3 is another view of the security device of FIG. 1 fitted to a ladder.

When the device has been sufficiently tightened to prevent removal of the scaffold board, a padlock 140 may be applied to the holes 134 and 130 as shown in FIG. 3.

I claim:

1. A security device for securing a scaffolding board to a ladder to prevent unauthorized use of the ladder, which ladder comprises first and second uprights spaced apart by a plurality of rungs, the security device comprising:

(a) strap means adapted to lay transversely across the scaffolding board when the scaffolding board is longitudinally aligned with the ladder and is juxtaposed the rungs of the ladder;

(b) ladder engaging means for attaching the strap means to the ladder;

(c) tightening means for the ladder engaging means, which tightening means is operable to cause said strap means to clamp said scaffolding board against said ladder whereby said scaffolding board may be held against removal from the ladder; and (d) locking means adapted to permit locking of the tightening means in a clamped position in which said scaffolding board is clamped against the ladder.

2. A security device as claimed in claim 1 wherein the strap means comprises a rigid elongate member.

3. A security device as claimed in claim 1 wherein the ladder engaging means comprises at least one hook for engaging said ladder.

4. A security device as claimed in claim 1 wherein said ladder engaging means is adapted to engage one of: the first upright and the second upright; a rung of the ladder; an upright and a rung of the ladder.

5. A security device as claimed in claim 1 wherein the ladder engaging means comprises first and second hook members.

6. A security device as claimed in claim 5 wherein one hook member is disposed at one end region of the strap means and the other hook member at another end region of the strap means.

7. A security device as claimed in claim 5 wherein at least one of said hook members is adapted to be adjustable so that it has a reach movable towards or away from the strap means.

8. A security device as claimed in claim 1 wherein the tightening means comprises a tightening member threaded for engagement with the ladder engagement means whereby rotation of said tightening member causes said ladder engagement means to approach said strap means thereby to permit engagement of a portion of the ladder between the ladder engagement means and the strap means.

9. A security device as claimed in claim 8 wherein said tightening member comprises a handle provided with an axis of rotation at which axis the handle is threaded.

10. A security device as claimed in claim 1 wherein the locking means comprises a lock and in particular a padlock.

11. A security device as claimed in claim 1 wherein the locking means comprises lock engagement means to which a separate known lock may be attached.

12. A security device as claimed in claim 11 wherein the tightening means comprises a tightening member threaded for engagement with the ladder engagement means whereby rotation of said tightening member causes said ladder engagement means to approach and engage the ladder and wherein said tightening member comprises a handle with a threaded axis of rotation and wherein the lock engagement means is defined by a first hole in the handle and a second hole in the strap means, which first hole in a clamping position may be aligned with the second hole, thereby to permit a padlock to be threaded through both holes.

13. A security device for securing a scaffolding board to a ladder in order to prevent unauthorized use of the ladder, which ladder comprises first and second uprights spaced apart by a plurality of rungs, the security device comprising an elongate rigid bar carrying at one end region thereof a first hook member which hook member comprises a stem portion and a hook portion, which stem portion threadably engages said elongate rigid bar thereby permitting movement of said first hook portion towards or away from the elongate bar by rotation of said hook member, and which hook portion is adapted to engage a rung or upright of said ladder, which rigid bar carries at another end region thereof a second hook member, which hook member comprises a stem portion and a hook portion, which stem portion slidably engages said rigid bar and which hook portion is adapted to engage a rung or an upright of said ladder, wherein a tightening handle threadably engages the stem of the second hook member thereby retaining the second hook member on the elongate bar and permitting movement of the hook portion towards the elongate bar by rotation of said handle, and wherein an extension of said rigid bar is provided with a hole with which hole may be aligned a hole in said tightening handle, thereby permitting locking of said handle against rotation by passing of a locking device such as a padlock through both holes.

* * * * *